United States Patent [19]

Lyden

[11] 4,342,376

[45] Aug. 3, 1982

[54] ADJUSTABLE CONSTANT LEVEL OILER AND TOOL FOR MAKING ADJUSTMENTS

[75] Inventor: Frank J. Lyden, Manitowoc, Wis.

[73] Assignee: Oil-Rite Corporation, Manitowoc, Wis.

[21] Appl. No.: 110,180

[22] Filed: Jan. 7, 1980

[51] Int. Cl.[3] ..... G05D 9/02; F01M 11/12

[52] U.S. Cl. ..... 184/103 R; 137/453; 184/96

[58] Field of Search ..... 184/103 R, 96; 285/89, 285/92; 137/393, 395, 453, 454

[56] References Cited

U.S. PATENT DOCUMENTS

| | | | |
|---|---|---|---|
| 1,483,545 | 2/1924 | Evers | 184/103 R |
| 1,770,036 | 7/1930 | Johnson | 184/103 R |
| 1,931,278 | 10/1933 | Wilkes | 137/453 X |
| 2,282,275 | 5/1942 | Westburgh | 184/103 R |
| 2,586,104 | 2/1952 | Smyser | 184/103 R |
| 2,672,951 | 3/1954 | Bogert | 184/103 R X |
| 2,979,161 | 4/1961 | Lyden | 184/103 R |
| 3,590,857 | 7/1971 | Gruett | 184/103 R X |

*Primary Examiner*—David H. Brown

*Attorney, Agent, or Firm*—Andrus, Sceales, Starke & Sawall

[57] ABSTRACT

A constant level oiler is disclosed which includes an adjustable nozzle assembly for establishing the operating or working level of the oil lubricant in the oil chamber and to a user assembly. A tool is further disclosed which is insertable into the oiler chamber for making the desired nozzle assembly adjustments.

4 Claims, 7 Drawing Figures

Fig. 1
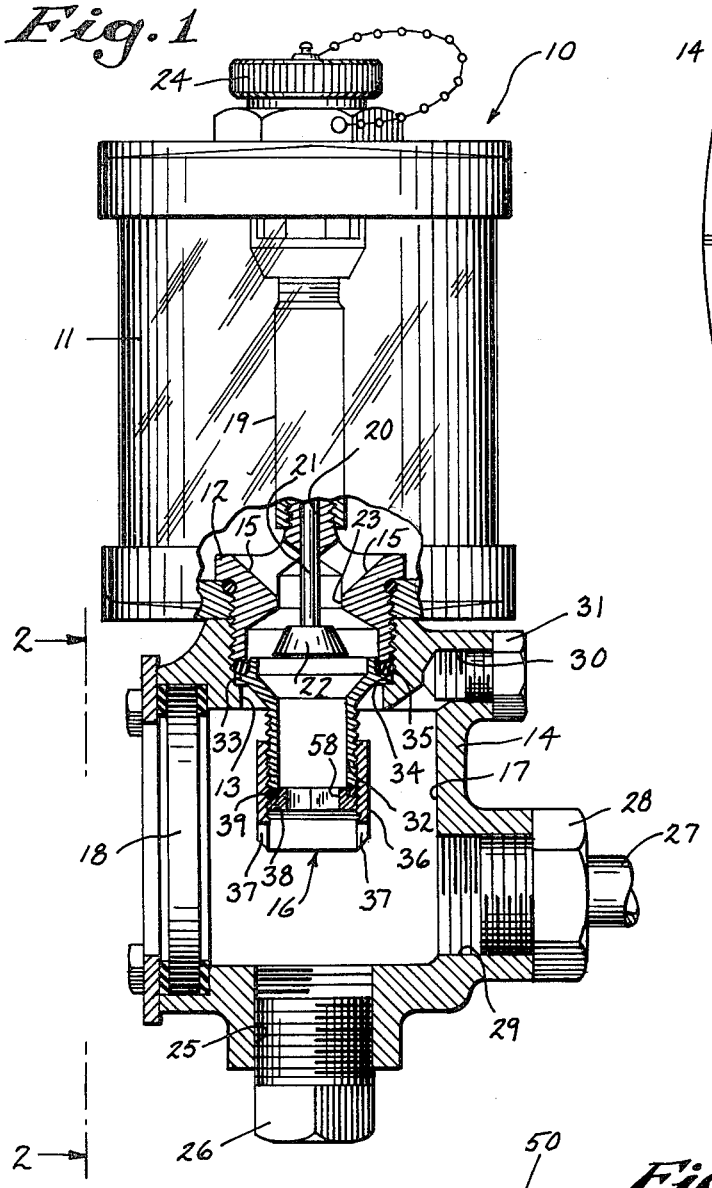
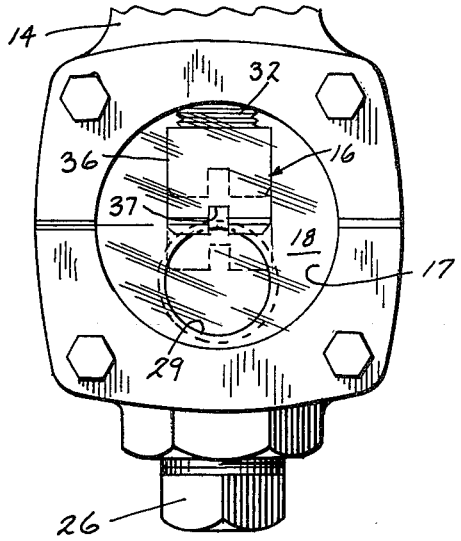
Fig. 2
Fig. 5
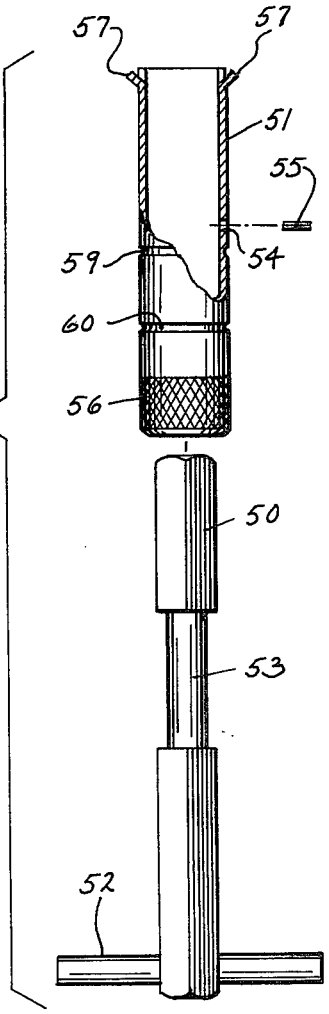
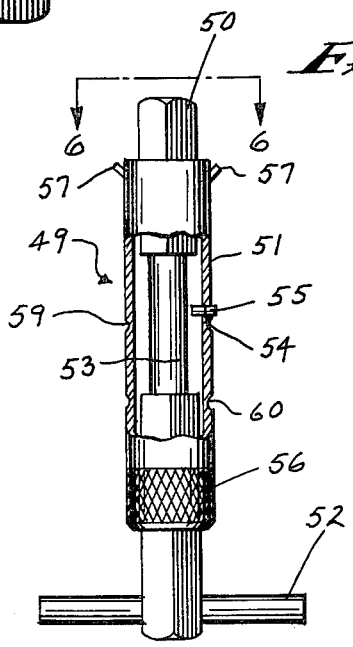
Fig. 4

ADJUSTABLE CONSTANT LEVEL OILER AND TOOL FOR MAKING ADJUSTMENTS

BACKGROUND OF THE INVENTION

This invention relates to a constant level oiler with an adjustable nozzle assembly for establishing the operating or working level of the oil lubricant to a user assembly, and to a tool for making nozzle assembly adjustments.

Most constant level oilers formerly were not adjustable to establish the working level of the oil lubricant to a user assembly. When a remote mounting for the oiler was provided, the mounting height could be altered to attain an adjustment. When remote mounting was not provided, and the level of the oil lubricant was to be raised, the constant level oiler could be disassembled and its nozzle shortened as by filing. At other times the direct mounting tube had to be altered or replaced to make a needed adjustment. Generally, installation of a new oiler, or an adjusting alteration of an existing installation, proved to be a time consuming job.

The oilers that were adjustable are provided with a telescoping oil chamber wherein the reservoir along with a fixed nozzle and oil chamber bonnet are movable as a unit to adjust the working level of the oil lubricant. In these oilers set screws fastened externally secure the movable unit in adjusted position. Generally, the arrangement is suited only to oilers of relatively small reservoir capacity and is not tamperproof.

It is generally an object of this invention to provide a constant level oiler which is adjustable to establish the working level of the oil lubricant to a user assembly for most any size of reservoir, and because the adjustment is made internally of the oiler, it will be tamperproof.

SUMMARY OF THE INVENTION

The invention is directed to a constant level oiler having an oil lubricant chamber. A nozzle assembly is supported at its upper end within the oiler and projects downwardly into the chamber and serves to establish the working or operating level of the oil lubricant in the chamber. The nozzle assembly comprises a pair of threadedly engaged tubular members with one of the members projecting downwardly beyond the end of the other of said members and is movable vertically relative to the other of said members to provide for adjustment of the operating level of the oil lubricant in the chamber. Means are further provided to lock the nozzle assembly members in any desired position of adjustment.

The invention further resides in a tool for making an oil lubricant level adjustment in the chamber of the constant level oiler. The tool is insertable through a bottom opening aligned with and providing access to the spout of the nozzle assembly. The tool includes first means engageable with the lock means and a second means engageable with the spout. The first and second means of the tool are separately manipulatable to initially unlock the lock means, effect and adjusting movement of the spout to a new position of adjustment, and thereafter to relock the spout relative to the nozzle assembly.

DESCRIPTION OF THE DRAWING FIGURES

The drawings furnished herewith illustrate the best mode presently contemplated for carrying out the invention and are described hereinafter.

In the drawings:

FIG. 1 is a side elevation partially in section of a constant level oiler provided with a nozzle assembly having an adjustable spout;

FIG. 2 is a view taken generally on lines 2—2 of FIG. 1 and shows the adjustable spout in factory set position and in dashed lines generally indicates the range of possible adjustment for the spout;

FIG. 4 is a side elevation partially in section of a tool for adjusting the spout of the nozzle assembly to provide for the proper oil level for lubrication;

FIG. 5 is an exploded view of the tool of FIG. 4;

DESCRIPTION OF THE ILLUSTRATED EMBODIMENT

Figure 3:
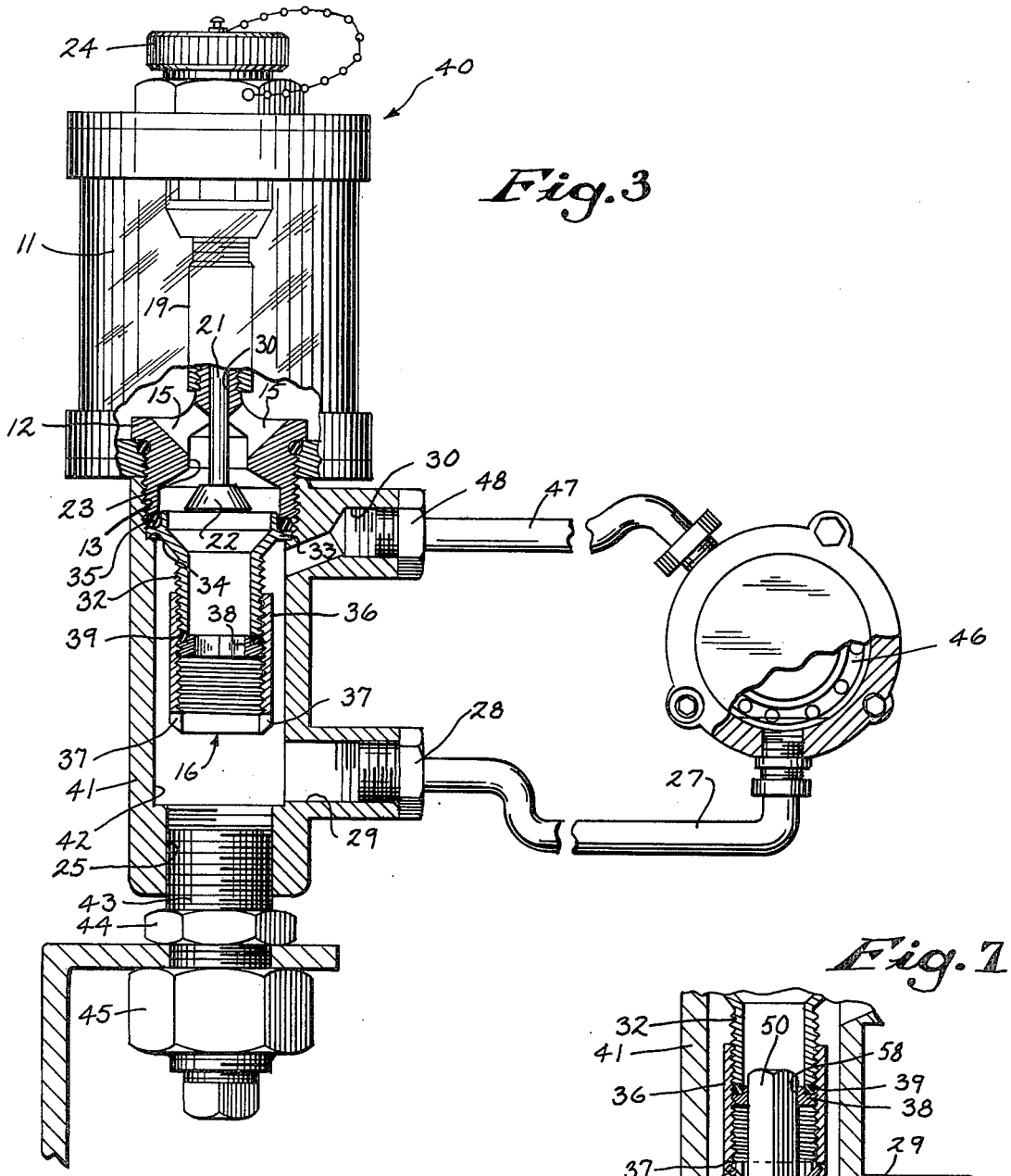
FIG. 3 is a side elevation partially in section and shows a constant level oiler as generally installed for lubricating a bearing and with pressure equalized between the oiler and bearing.

Referring to the drawings, the constant level oiler 10 of FIG. 1 provides for and maintains a constant level of oil lubricant in a user assembly, not shown, such as a bearing, gear case, pillow block, etc.

The oiler 10 includes an oil supply reservoir 11 provided with a hollow threaded base fitting 12 for mounting engagement within the threaded opening 13 of the hollow lower body 14. Oil from the reservoir 11 passes through a plurality of passages 15 in the base fitting 12, the body opening 13, and the nozzle assembly 16 into the oil chamber 17 of the body 14. The level of the oil in chamber 17 may be observed through the sightglass 18.

The reservoir 11 is provided with a tubular column 19 centrally having a bore 20 therein. The stem 21 of a closure valve 22 is slidably disposed in the bore 20 and is normally biased to close the valve against the annular seat 23 in the base fitting 12.

The oil in the reservoir 11 is replenished through an upper opening which is closed by the filler cap 24. When the filler cap 24 is removed, the valve 22 is biased to the closure position against the seat 23 so that the oil level in chamber 17 and the user assembly remains unaffected during oil replenishment. When the filler cap 24 is replaced in closure position, a downwardly extending projection, not shown, extends from the cap 24 into the bore 20 and engages with the upper end of the valve stem 21 to reopen the valve 22 and reestablish communication between the reservoir 11 and the chamber 17. The reservoir 11 and the passage to and through the nozzle assembly 16 must be airtight for the proper operation of the oiler 10.

The body 14 is provided with a threaded opening 25 in the base thereof somewhat larger and in alignment with the free end of the nozzle assembly 16. The opening 25 is normally closed by a threaded plug 26. The chamber 17 communicates with the user assembly through the tubular member 27 which is secured to the body 14 by the threaded fitting 28 engaged in the side opening 29. The side opening 29 is provided relatively low in relation to the chamber 17. The chamber 17 is also vented to the atmosphere through the threaded opening 30 in the body 14 into which a filter fitting 31 is normally engaged to preclude the entry of any deleterious matter. The vent opening 30 is generally placed as high as possible relative to chamber 17 to provide an adequate capacity for oil that surges back into the chamber upon shut-down at the user assembly.

The nozzle assembly 16 of the oiler 10 includes a funnel-shaped nozzle member 32. The member 32 is provided with an annular radial flange 33 exteriorly and adjacent to the relatively wide mouth thereof for seating on the annular shoulder 34 provided in the stepped opening 13 of the body member 14. The member 32 is held in place by the lower end of the base fitting 12 with an O-ring seal 35 wedged therebetween.

The lower cylindrical portion of the funnel-shaped member 32 is threaded externally to receive the internally threaded spout member 36 on the end thereof. The free open end of the spout member 36 is provided with a pair of diametrically opposed, generally rectangular recesses or notches 37 the upper ends of which establish the desired operating level of the oil lubricant in the chamber 17 and the user assembly. The width of the notches 37 is also believed to determine the size of the air bubbles vented into the reservoir 11 when the liquid seal along the upper edge of the notches is broken as the oil level in chamber 17 drops because of oil consumption in the user assembly. When the liquid seal at the notches 37 is broken, the air vented into the otherwise airtight reservoir 11 releases adequate oil lubricant to reestablish the liquid seal and thereby maintain the oil level in the chamber 17 generally constant.

The spout 36 is adjustable relative to the funnel-shaped member 32 as indicated by the dashed lines in FIG. 2 which generally show the range of possible adjustment. The solid line position of FIG. 2 generally indicates the factory set position which is about midway relative to the range of possible adjustment. An annular exteriorly threaded lock nut 38 is threaded inside of the spout member 36 to engage the lower end of the member 32 with a sealing ring 39 wedged therebetween to lock the spout member relative to the member 32 in any position of adjustment.

The constant level oiler 40 of FIG. 3 is similar in many respects to the oiler 10 of FIG. 1 and like reference numerals are used to designate parts that are generally the same.

In the oiler 40 the reservoir 11 is mounted on a lower body 41 having no sightglass for viewing the interior of the chamber 42. The threaded bottom opening 25 of body member 41 is closed by a longer threaded plug 43 adapted to receive the nuts 44 and 45 for securing a mounting member, shown in part, therebetween to mount the oiler 40 remote but generally adjacent to the user assembly.

The oiler 40 is shown installed to provide oil lubricant for an anti-friction bearing 46, the lower end of which communicates with the chamber 42 through the tube 27. As was described relative to the oiler 10, the oil lubricant level in the bearing 46 is established by the height or level of the upper edges of the notches 37 of the spout member 36 in chamber 42 of the oiler 40. In the installation of FIG. 3 the pressure in the bearing 46 and the chamber 42 are equalized through the tube 47 which extends from the upper portion of the bearing housing for connection to the vent opening 30 in the body 41 by the threaded fitting 48.

The factory set position of the spout member 36 in the oilers 10 and 40 may not accord with the needs of the customer, making some adjustment of the spout member relative to the nozzle member 32 necessary. While a customer can disassemble the oiler to make the needed spout member adjustment, such a course is not only time consuming, but is also done at some risk of improper reassembly, particularly at the several sealed connections. To avoid such a course, the tool 49 may be utilized to make any needed spout member adjustment.

Figure 6:
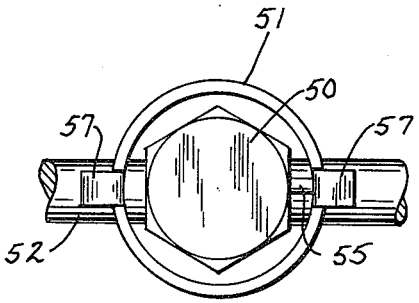
FIG. 6 is an enlarged and elevation of the tool taken generally on line 6—6 of FIG. 4.

As shown in FIGS. 4–6, the tool 49 generally consists of two principal elements; namely, a hex wrench 50 and a cylindrical sleeve 51. The hex wrench 50 includes a T-handle 52 providing for finger manipulation. Intermediate its length, the hex wrench 50 is also provided with a radially reduced cylindrical section 53. The sleeve 51 is slidable over the hex wrench 50 as generally shown in FIG. 4 and is provided with a hole 54 intermediate its length. With the sleeve 51 disposed on the hex wrench 50, a press fit pin 55 projecting radially through the hole 54 at the reduced section 53 of the wrench makes the sleeve captive on the wrench but movable longitudinally thereon within limits set by the T-handle 52 at the one end and the interference between the pin 55 and the enlarged hex portion of the wrench at the free or working end of the tool 49. The assembled hex wrench 50 and sleeve 51 are separately rotatable either clockwise or counterclockwise. The end portion of the sleeve 51 adjacent to the T-handle 52 is provided with a knurled portion 56 to provide for easy finger manipulation. Adjacent to the opposite or working end of the sleeve 51, a pair of diametrically opposed prongs 57 project angularly outwardly.

If needed, adjustment of the spout member 36 relative to the nozzle member 32 is ordinarily effected prior to installation of the oiler. In any event, such an adjustment must be made when the oiler is empty of oil lubricant content.

To make an adjustment of the spout member 36 relative to the nozzle member 32, it is necessary to open the bottom outlet 25 to permit the insertion of the working end of the tool 49 through the opening. Initially the working end of the hex wrench 50 is engaged within the hex opening 58 of the internal lock nut 38 and the working end of the sleeve 51 is engaged within the open end of the spout member 36 with the diametrically opposed prongs 57 engaged with the corresponding notches 37 at the end of the spout member as generally shown in FIG. 7.

The relative position of the end of the spout member 36 prior to adjustment can be ascertained initially relative to a pair of axially spaced lines or marks 59 and 60 impressed on the outer surface of the sleeve 51. The space between the lines 59 and 60 corresponds to the full range of adjustment possible for the spout member 36. When the spout member 36 is to be adjusted from the factory set position which is generally at the midpoint of the range of adjustment, that position will be ascertainable relative to the sleeve 51 at the exit plane 61 of the bottom outlet 25 where the exit plane extends generally midway between the lines 59 and 60 as generally shown in FIG. 7. From the position illustrated in FIG. 7, adjustment of the spout member 36 either up or down is possible with the limit of adjustment being indicated when the respective lines 59 and 60 coincide with the exit plane 61.

Figure 7:
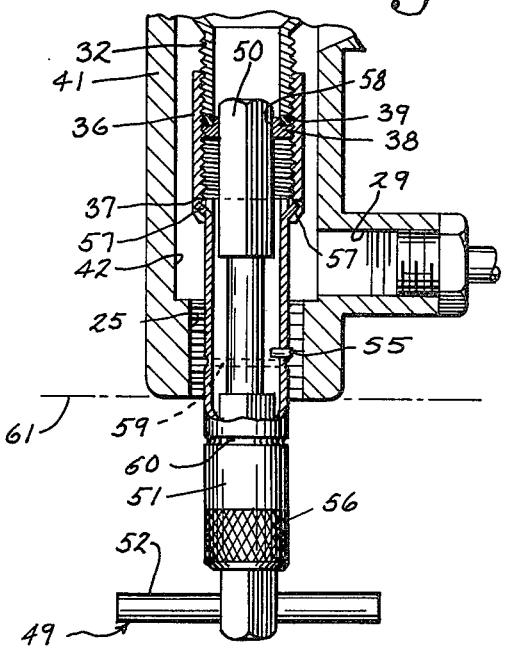
FIG. 7 is a sectional view showing the tool of FIG. 4 in engaged position to make a desired adjustment for the spout.

To make an adjustment of the spout member 36 upward to raise the level of the oil lubricant in the user assembly from the position shown in FIG. 7, the hex wrench 50 is turned in a counterclockwise direction to loosen and adequately back off the lock nut 38 and the sleeve 51 is rotated to provide the amount of upward adjustment desired for the spout member. After the spout member 36 has reached its adjusted position, the hex wrench 50 is rotated in a clockwise direction to relock the spout member in the newly adjusted position.

For an adjustment of the spout member 36 downwardly to lower the level of the oil lubricant in the user assembly from the position of FIG. 7, the hex wrench 50 is first again manipulated to loosen the lock nut 38 and thereafter the sleeve 51 is rotated to provide for downward adjustment of the spout member to the level desired. When the adjustment for the spout member 36 is completed, the lock nut 38 is again driven by the hex wrench 50 to relock the spout member.

The invention thus provides a constant level oiler having an adjustable nozzle assembly for establishing the operating level of the oil lubricant to the user assembly. The invention further provides a tool that provides for easy, rapid and accurate adjustment of the operating level for the oil lubricant fed to the user assembly by the constant level oiler. Since only the spout of the nozzle assembly is affected in the adjustment process, the balance of the oiler can remain standard even over a relatively wide range of reservoir sizes. Since the adjustments are made interiorly of the oiler, the settings are generally tamperproof.

Various modes of carrying out the invention are contemplated as being within the scope of the following claims particularly pointing out and distinctly claiming the subject matter which is regarded as the invention.

I claim:

1. In a constant level oiler, a reservoir for oil lubricant, a lubricant chamber beneath the reservoir and having vent means spaced above the lubricant level in said chamber to provide a surge space, conduit means placing the reservoir in communication with the lubricant chamber, valve means in said conduit means to selectively close the conduit means to preclude lubricant flow between the reservoir and the lubricant chamber, said conduit means including a nozzle assembly projecting downwardly into the lubricant chamber and serving to establish the operating level of the oil lubricant in the chamber, said nozzle assembly comprising a pair of threadedly engaged tubular members with one of said members being generally fixed and the other of said members projecting downwardly beyond the free end of the fixed member and being movable vertically relative to the fixed member to provide for adjustment of the operating level of the oil lubricant in said chamber, and means to lock the nozzle assembly members together in any desired position of adjustment.

2. The structure as set forth in claim 1 wherein the lower end of the movable nozzle assembly member is provided with at least one vertically extending notch with the upper edge of the notch serving to establish the operating level of the oil lubricant in the chamber.

3. The structure as set forth in claim 1 wherein the generally fixed tubular member of the nozzle assembly is threaded externally and the movable tubular member is threaded internally and engaged upon the fixed tubular member.

4. The structure as set forth in claim 3 wherein the lock means comprise an annular lock nut threadedly engaged internally of the movable nozzle assembly member for abutting on the end of the generally fixed tubular member to effect a locked condition for the movable member.

* * * * *